US006580337B1

(12) United States Patent
Valas

(10) Patent No.: US 6,580,337 B1
(45) Date of Patent: Jun. 17, 2003

(54) MEMS SWITCH

(75) Inventor: Sam Valas, Granada Hills, CA (US)

(73) Assignee: California Institute of Technology, Pasadena, CA (US)

( * ) Notice: Subject to any disclaimer, the term of this patent is extended or adjusted under 35 U.S.C. 154(b) by 0 days.

(21) Appl. No.: 09/575,706

(22) Filed: Jul. 19, 2000

Related U.S. Application Data

(60) Provisional application No. 60/144,489, filed on Jul. 19, 1999.

(51) Int. Cl.[7] ..... H01P 1/10
(52) U.S. Cl. ..... 333/105; 333/262
(58) Field of Search ..... 333/105, 104, 333/262, 101

(56) References Cited

U.S. PATENT DOCUMENTS 3,678,414 A * 7/1972 Hallford ..... 333/104
5,619,061 A * 4/1997 Goldsmith et al. ..... 257/528
6,014,066 A * 1/2000 Harberts et al. ..... 333/104

* cited by examiner

*Primary Examiner*—Robert Pascal
*Assistant Examiner*—Dean Takaoka
(74) *Attorney, Agent, or Firm*—Fish & Richardson P.C.

(57) ABSTRACT

A microstrip single pole double throw switch incorporating multiple MEMS contacts. A first pair of contacts is located adjacent to the junction of input and output lines for optimization of performance bandwidth. The MEMS contacts that are not located adjacent to the junction are spaced along the output lines to further optimize the bandwidth and isolation in the off state, while minimizing insertion loss in the on state.

5 Claims, 3 Drawing Sheets

MEMS SWITCH

CROSS REFERENCE TO RELATED APPLICATIONS

Continuity Statement

This application claims benefit of U.S. Provisional application No. 60/144,489, filed Jul. 19, 1999.

FEDERAL RESEARCH STATEMENT

The invention described herein was made in the performance of work under a Government contract, and is subject to the provisions of Public Law 96-517 (U.S.C. 202) in which the Contractor has elected to retain title.

BACKGROUND OF THE INVENTION

Single pole double throw switches can be fabricated using a number of different fabrication technologies. Typical ways use semiconductor devices such as PIN diodes or MESFETS. However, these devices have finite reactances and resistances that can cause problems of limiting bandwidth, insertion loss, isolation, and power handling capability. The non-linearities caused by these devices can cause intermodulation distortion at RF power levels. The power dissipation can also be a problem.

MEMS switches are known for creating RF components. Single pole single throw (SPST) MEMS switches or contacts are know. However, little work has been done to implement these contacts into a single pole double throw (SPDT) architecture, which is a widely used form isolation while retaining low insertion loss and wide bandwidth. Other desirable features include low power dissipation and low intermodulation distortion.

SUMMARY OF THE INVENTION

The present application teaches a system which exhibits these attributes in an RF SPDT switch. Operations that are described herein produce a layout in which isolation is maximized over an extremely wide frequency range while maintaining excellent insertion loss. In addition, the use of MEMS enables power dissipation and intermodulation distortion to be minimized.

BRIEF DESCRIPTION OF DRAWINGS

These and other aspects will now be described in detail with reference to the accompanying drawings in which.

DETAILED DESCRIPTION

Figure 1A:
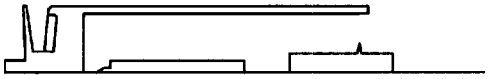
FIGS. 1A, 1B, and 2 show basic layouts of a MEMS SPST contact.
Figure 1B:
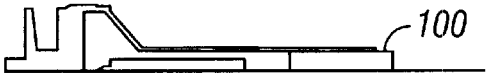
Figure 2:
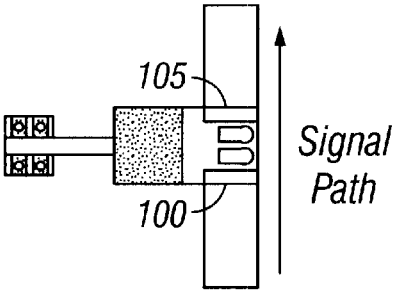

The basic layout of the switch is shown in FIGS. 1A, 1B and 2. These switches are described in Elliott R. Brown, "RF-MEMS Switches for Reconfigurable Integrated Circuits," IEEE Transactions on Microwave Theory and Techniques, Vol. 46, No. 11, November 1998, and are available from HRL Laboratories. FIG. 1A shows how the switch can be in its inactive state, in which case there is no connection between the two electrodes 100, 105. The switchable part can be attracted by the pull down electrode. This makes contact as shown in FIGS. 1B, 2, causing a short circuit across the signal path. This forms a single pole single throw (on or off) switch.

Figure 3:
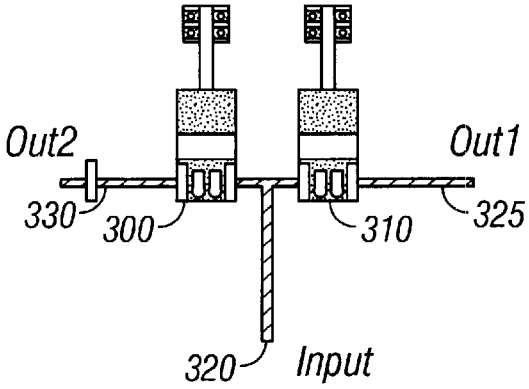
FIG. 3 shows a basic SPDT switch.

FIG. 3 shows a first embodiment of the novel SPDT switch, in which two of the MEMS SPST contacts, here 300 and 310, are placed very close to the junction of a planar "T" line on a thin (approx. 4 mil) semiconductor or ceramic substrate. The line 320 forms the single input or "single-pole" of the SPDT switch. A first output line Out1 forms a first output 325 of the circuit. A second output line 330 forms Out2. These two outputs make up the "double-throw" portion of the SPDT switch. The contacts 300, 310 are typically in opposite states at any one time, either open or closed to proved a block in one output line and a conduction path from input to output in the other output line. While this embodiment of the SPDT switch operates adequately, the isolation through the undesired path at high frequencies, e.g. 30 GHz, is only about 28 dB. This is often not satisfactory for many applications.

Figure 4:
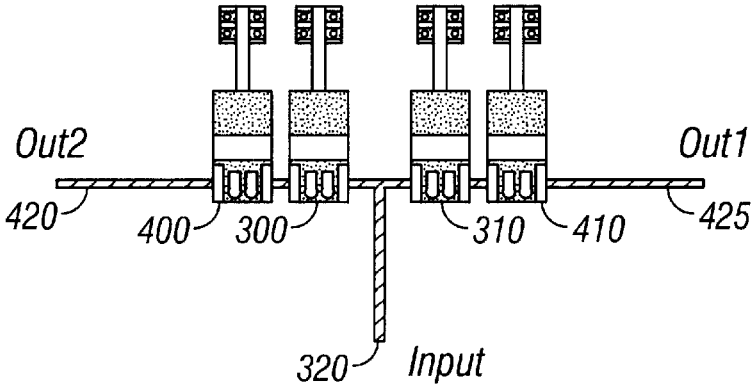
FIG. 4 shows an embodiment that uses additional contact structures to increase the off isolation.

FIG. 4 shows another embodiment that uses respective second contact structures, 400, 410, providing two contacts (300, 400 or 310, 410) in series on each output line of the switch. The two contacts on each output line are placed in the same state (open or closed) at any one time. For the input 320 to output path comprised of the open contacts, the isolation is increased by about 12 dB.

Figure 5:
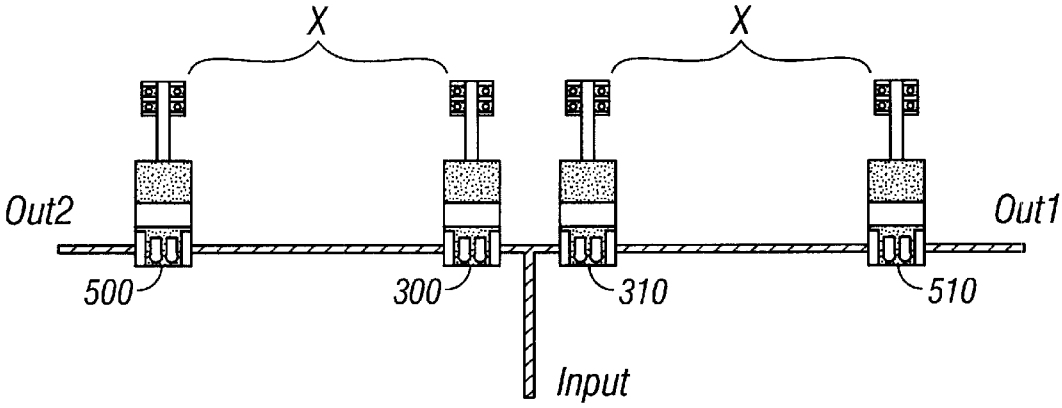
FIG. 5 shows another embodiment in which second contact structures are spaced by a specified amount from the first contact structures.

FIG. 5 shows an improved embodiment, in which the second contact structures 500 and 510 are spaced by a specified amount (x) from the respective first contact structures 300 and 310. A high frequency is selected, here 30 GHz. This wavelength is used to set distances. The contact 500 is spaced a distance from its series neighbor 300, that is a quarter wavelength of 30 GHz.

Figure 6:
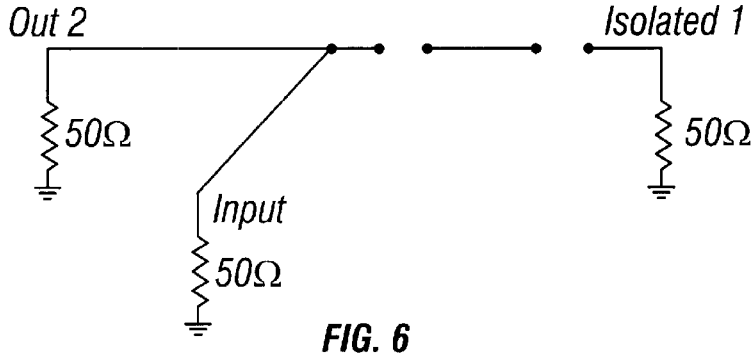
FIGS. 6, 7, and 8 show schematics which explain the high open switch impedance at multiple frequencies.

This system increases the isolation by more than 30 dB across the entire band as compared with the switch in FIG. 3. The reasons for this are explained with reference to the equivalent schematics of FIGS. 6, 7, and 8. The SPDT switch can be seen as three equivalent circuits at three different frequencies. FIG. 6 shows a low frequency equivalent circuit, e.g. less than 10 MHz. The equivalent circuit of the blocked output path is effectively two open circuits, thereby providing high isolation between the input and the isolated1 (output). The input remains connected to the conducted path through out2.

Figure 7:
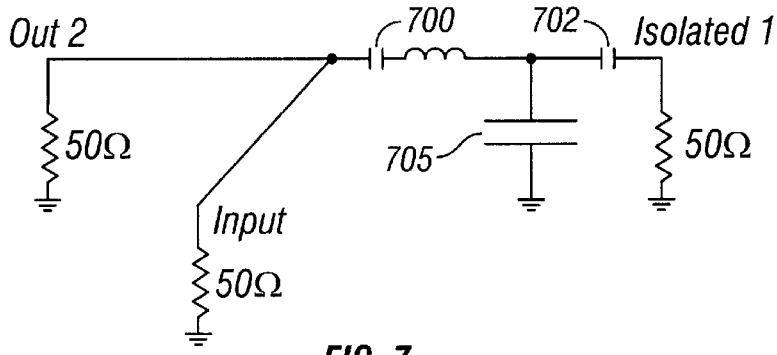

FIG. 7 illustrates the intermediate frequencies between 10 MHz and 28 GHz. At this frequency level, the isolation is achieved by two small series capacitors 700 and 702 with a larger parallel capacitance 705. This effectively forms a low pass filter, and enhances the isolation over this large part of the frequency band.

Figure 8:
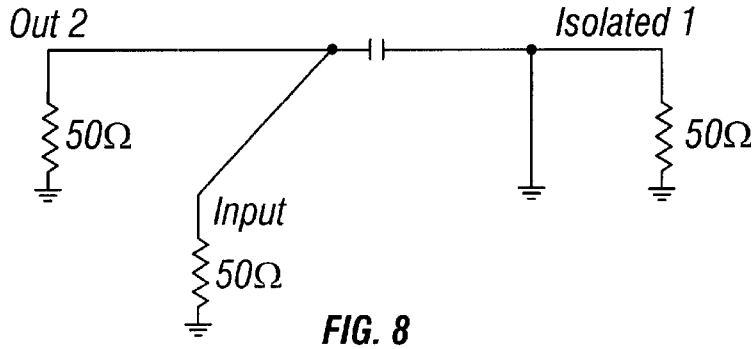

At high frequencies, e.g. between 28 to 30 GHz, FIG. 8 illustrates the small series capacitance, terminated in a short circuit, that provides the isolation. This embodiment of the SPDT switch exhibits superior performance. For example, simulations indicate that the switch can have less than 0.4 dB insertion loss, greater then 58 dB isolation, and greater than 28 dB of return loss all the way from 0 (DC) to 30 GHz.

Figure 9:
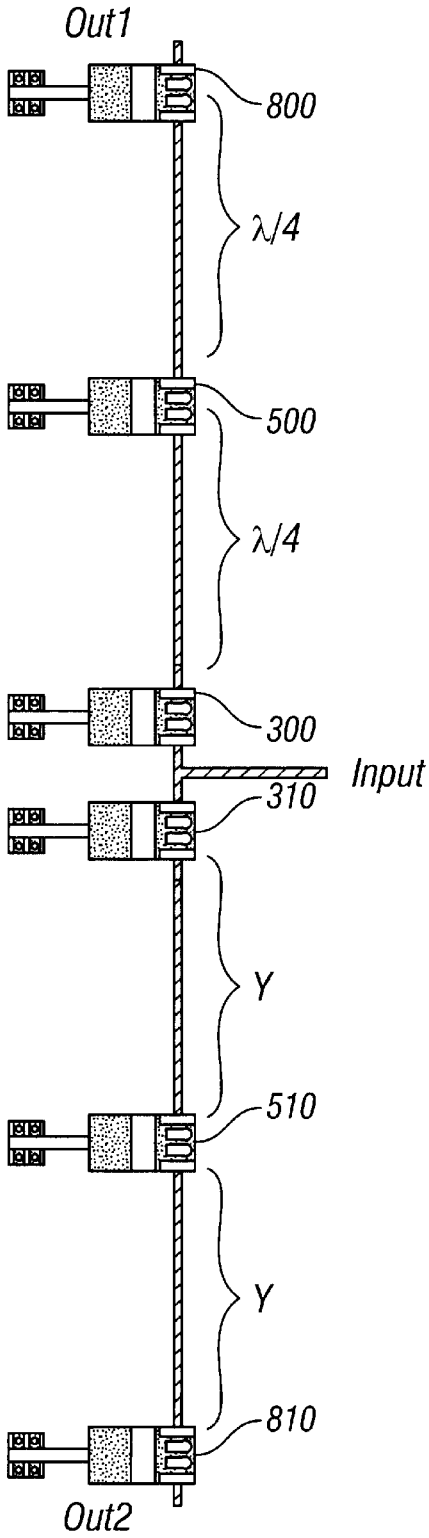
FIG. 9 shows additional contact structures being added.
Figure 10:
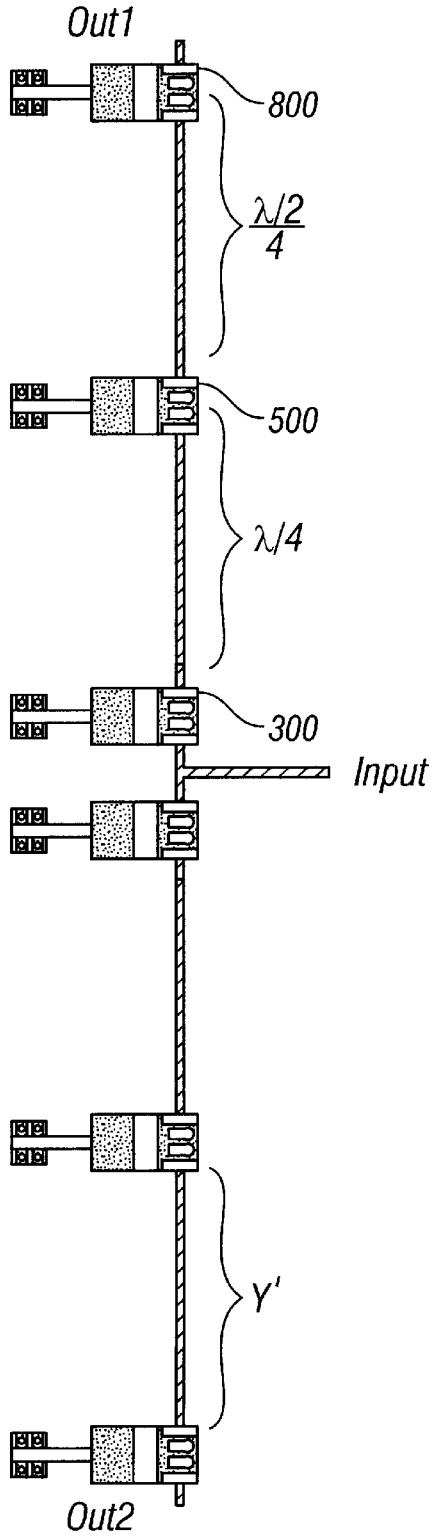
FIG. 10 shows spacing distances by a specified quarter wavelength to maintain high isolation.

A second arrangement is shown in FIG. 9. While this switch is shown as larger, the actual size is still about 3 mm2.

Additional contacts 800, 810 are added to the contacts of FIG. 5 (300, 310, 500, 510). This contact structure is spaced by a distance y=a 30 GHz quarter wavelength, on both sides of the circuit. This switch improves the isolation by almost 30 dB to provide a switch with 85 dB of isolation, and less than half a dB of insertion loss across the entire band of 0–30 GHz. One possible problem with the switch of FIG. 9 is at higher frequencies. At around 60 GHz, isolation degrades to about 30 dB, because the quarter wavelength lines do not provide the proper impedance transformation. If the system has high second harmonic levels, this isolation can be a problem even when lower wavelengths are used.

Therefore, an alternative embodiment would change [the distances in FIG. 9 from x to x' and y to y', both a 60 GHz quarter wavelength. When this is done, the isolation at 60 GHz improves by more than 30 dB to 65 dB total, while the lower frequency performance stays comparable and the overall size decreases to about 2 $mm^2$.

What is claimed is:

1. A SPDT MEMS switch, comprising:

a connection;

first and second MEMS contact elements, respectively provided on respective sides of said connection and directly adjacent said connection;

said first contact being actuated to provide an output from the connection in a first direction and said second MEMS contact being actuated at a different time than actuation of the first contact to provide an approximately equal output from the connection in a second direction; and at least two additional switches located in specified locations to enhance isolation at RF frequencies.

2. A switch as in claim 1 wherein said at least two additional MEMS switches are located at a quarter wavelength of the specified frequency.

3. A switch as in claim 2 further comprising two additional MEMS contacts located at quarter wavelength of a specified frequency.

4. A SPDT MEMS switch as in claim 3 configured to suppress the second harmonic of the specified frequency by locating all additional switches at a quarter wavelength of a second harmonic.

5. A SPDT MEMS switch as in claim 2 wherein said specified frequency is 30 GHz.

* * * * *